United States Patent [19]

Stahlherm et al.

[11] Patent Number: 4,614,567

[45] Date of Patent: Sep. 30, 1986

[54] METHOD AND APPARATUS FOR SELECTIVE AFTER-QUENCHING OF COKE ON A COKE BENCH

[75] Inventors: Dieter Stahlherm, Recklinghausen; Reimer Haack, Haltern; Wilhelm Stewen, Dortmund; Helmut Lukaszewicz, Bottrop, all of Fed. Rep. of Germany

[73] Assignee: Firma Carl Still GmbH & Co. KG, Fed. Rep. of Germany

[21] Appl. No.: 752,183

[22] PCT Filed: Oct. 24, 1984

[86] PCT No.: PCT/EP84/00325

§ 371 Date: Jun. 12, 1985

§ 102(e) Date: Jun. 12, 1985

[87] PCT Pub. No.: WO85/01953

PCT Pub. Date: May 9, 1985

[30] Foreign Application Priority Data

Oct. 28, 1983 [DE] Fed. Rep. of Germany ..... 3339160

[51] Int. Cl.[4] ..... C10B 39/06; G01J 5/00

[52] U.S. Cl. ..... 201/1; 201/39; 202/227; 202/230; 202/262; 374/124; 374/142

[58] Field of Search ..... 374/141, 142, 124, 137, 374/111; 202/227

[56] References Cited

U.S. PATENT DOCUMENTS

| | | | |
|---|---|---|---|
| 3,535,630 | 10/1970 | McMullen | 374/142 X |
| 3,580,813 | 5/1971 | Hinchliffe | 202/230 |
| 4,066,159 | 1/1978 | Romovacek | 203/2 X |
| 4,111,757 | 9/1978 | Ciarimboli | 202/227 X |
| 4,246,072 | 1/1981 | Brommel | 202/227 X |
| 4,358,343 | 11/1982 | Goedde et al. | 202/227 X |
| 4,409,067 | 10/1983 | Smith | 202/227 X |
| 4,439,049 | 3/1984 | Hoogendoorn et al. | 374/124 |
| 4,452,538 | 6/1984 | Roger et al. | 374/137 |
| 4,539,588 | 9/1985 | Ariessohn | 374/124 X |

*Primary Examiner*—Daniel M. Yasich

*Attorney, Agent, or Firm*—McGlew and Tuttle

[57] ABSTRACT

Method and apparatus for detection and selective after-quenching of red hot pockets in previously quenched hot coke lying on a coke bench, in which the temperature of the coke is sensed and recorded over the entire surface or area of the coke bench by temperature sensors installed thereabove, and if excessively hot coke portions or local areas are found, only those excessively hot coke portions are acted upon for after-quenching automatically in controlled manner with a focused water jet or spray using only a minimum amount of water for as short a time as possible.

20 Claims, 5 Drawing Figures

METHOD AND APPARATUS FOR SELECTIVE AFTER-QUENCHING OF COKE ON A COKE BENCH

FIELD AND BACKGROUND OF THE INVENTION

The invention relates to a method for the detection of red heat pockets and for quenching the coke lying on the coke bench, and to devices for carrying out this method.

The red hot coke ejected from the coke oven chamber is normally pushed into a quenching carriage and is quenched or prequenched under a quenching tower by spraying with water. Thereafter the quenching carriage travels to a coke bench on which it stays for a while for final cooling and steaming of the so-quenched or prequenched coke out before it is transported to the coke screening plant by means of a bench draw-off belt or conveyor belt. Normally the coke should be completely quenched or prequenched when being charged on to the coke bench. On the other hand, during quenching or prequenching under the quenching tower and during after-quenching or requenching on the coke bench the coke should not be treated unnecessarily with too much water, whereby to avoid too high a water content of the coke. Rather, the water content of the coke should be kept uniform and low to the extent possible. As a result, unfortunately, it often happens that certain coke portions of the so-quenched or prequenched coke on the coke bench are still red hot. To prevent this red hot coke from getting onto the following rubber draw-off belt or conveyor belt and especially into the coke screening plant, it is absolutely necessary to after-quench or requench the so-called red heat pockets or red hot pockets or local areas of red hot coke which may occur on the coke bench. To watch the red heat pockets or red hot pockets occurring on the coke bench, heretofore there had to be an operator to after-quench or requench the red hot pockets by hand with a water hose. This usually led to gross or mass after-quenching or requenching over a large area with consumption of much water and to an excessive water content of large portions of coke.

It is indeed known to arrange above the ramp draw-off belt or conveyor belt, for control, individual temperature sensors which detect any still existing red hot coke on the conveyor belt and, if necessary, set in motion an after-connected water shower. This, however, is only a continuous observation of a single, relatively small point and is not suitable for observation of the large total surface of the coke bench.

SUMMARY OF THE INVENTION

It is now the object of the invention to automatically monitor the coke on the coke bench and to completely quench, i.e. after-quench or requench any red heat pockets using a minimum of water.

With the method according to the invention, the problem is solved in that the entire area of the coke bench is covered, monitored and recorded by temperature sensors installed thereabove and temperature recording means usable therewith, and if necessary, upon detection of overly hot coke portions in relation to a desired temperature value or standard, only these so-detected locally occurring individual relatively small areas or red hot pockets are treated automatically under the control of control means with a focused water jet for as short a time as possible to after-quench or requench only these portions selectively. It has been found, surprisingly, that also such a larger area of the coke bench can be monitored with the temperature sensors in a simple manner and that especially e.g. by means of a processor it is possible, upon the detection of overly hot coke portions, to immediately spray with water only those overly hot portions in dependence upon the sensed and recored temperature. In accordance with the more modern automatic bench draw-off systems it is possible with this new invention to completely dispense with a special operator at the coke bench.

According to the invention, in particular after detection of the hot coke portions, one can let the after-quenching or requenching operation start only after a given period of, i.e. delay time time. It has been found that certain hot coke portions cool off already after a very short time anyway, so that quenching, i.e. after-quenching or requenching, of the coke on the coke bench may be unnecessary. For this purpose either the temperature of the coke on the coke bench is recorded continuously for a certain period of time or the measurement is repeated at certain intervals.

The invention further provides that in case of a temperature increase of detected red heat pockets despite brief after-quenching or requenching the quenching process is repeated. For safety reasons permanent after-quenching or requenching may at the same time be switched to, stopping at the same time the bench draw-off belt and triggering an alarm. In this case, the stored data should be erased only manually and the bench draw-off belt should be restarted only after inspection by an operator.

To measure the temperature of the coke, the temperature sensors above the bench may also, according to the invention, be moved and the temperatures stored in an electronically simulated bench coordinate system, and after repeated travel over the bench, an increase or decrease of the temperatures can be detected by comparison with the stored data. Furthermore, synchronously with the temperature sensors also the after-quenching nozzles above the bench can be moved, quenching or requenching the individual red heat pockets after a time allowance, i.e. delay time. These two proposals as a whole have the advantage that each time only one row of temperature sensors or quenching nozzles is required, which cover simultaneously the total width of the bench. Especially in the case of a very long coke bench one can manage with few temperature sensors or quenching nozzles.

To carry out this method it is proposed to install the temperature sensors as well as the quenching nozzles on a common carriage which runs back and forth on its own rails in longitudinal direction above the coke bench. Section by section temperature sensors are to be installed which together cover the total width of the coke bench, and preferably a quenching nozzle is assigned to each of these temperature sensors. To reduce the number of temperature sensors and quenching nozzles, both of them may, according to the invention, be arranged movably on the carriage, namely in such a way that while the carriage is being moved in the longitudinal direction of the coke chamber or coke bench, they can be swung back and forth in the transverse direction of the coke chamber or coke bench. In the extreme case one could thus manage e.g. with one temperature sensor and one quenching nozzle, which in the position of rest, cover only a fraction of the width of the coke bench, but due to the ability to swing in transverse direction they cover in all, the total width of the coke bench.

For the water supply, according to the invention two different forms of realization are proposed as delivery means for the water supply source. One form provides a flexible connecting line between a stationary connection and the quenching nozzles on the carriage, the flexible line being adapted to wind on and off a drum during travel of the carriage. Directly connected with this drum for the water line there might be a second drum to receive the electric lines. In addition, the automatic position detector of the carriage might be connected with these drums.

As a possible alternative form of realization it is proposed according to the invention to arrange along the coke bench a water trough, from which water can be taken at any point of the coke bench, and to equip the carriage with a pump to deliver water to the quenching nozzles.

Besides the arrangement of the temperature sensors and quenching nozzles on a movable carriage, the invention proposes arranging these temperature sensors and quenching nozzles above the coke bench at one or more fixed points. The size of the area to be measured is determined according to the measuring angle of the temperature sensors or, respectively, according to the spraying angle of the quenching nozzles and the height of the arrangement of these devices above the coke bench. In any event, one temperature sensor or respectively one quenching nozzle should then cover the total width of the quenching bench. Now if the temperature sensors and quenching nozzles are arranged movably at on the fixed points, they can also be controlled in such a way that the coke bench is picked up or monitored successively row by row or that specific points of the coke bench are aimed at or monitored.

Lastly it is possible also to arrange at the fixed points infrared cameras for the plotting of thermo patterns. These thermo patterns can then be evaluated in a manner known in itself, and from there the respective commands for the activation of the quenching nozzles can be given. Also, a larger number of quenching nozzles, controllable singly or by rows, may be arranged uniformly distributed over the entire coke bench. In this case, appropriately the quenching nozzles would be arranged fixedly and optionally at a central location the respective valves in the feed lines to the quenching nozzles would be operated.

BRIEF DESCRIPTION OF THE DRAWINGS

The invention will be explained more specifically with reference to the attached figures by way of example.

DESCRIPTION OF THE PREFERRED EMBODIMENTS

Figure 1:
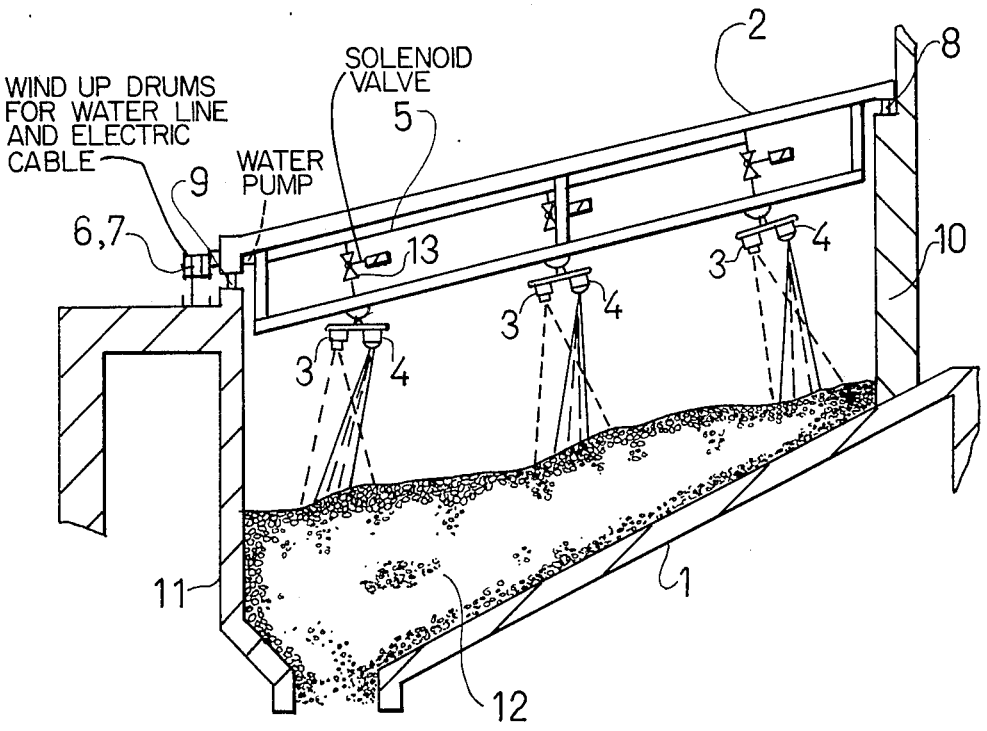
FIGS. 1 to 3 show respectively a transverse section of the coke bench, there being illustrated in FIG. 1 the carriage according to the invention with the temperature sensors and quenching nozzles installed thereon, and in FIGS. 2 and 3, the fixed supports with the temperature sensors and quenching nozzles.
Figure 5:
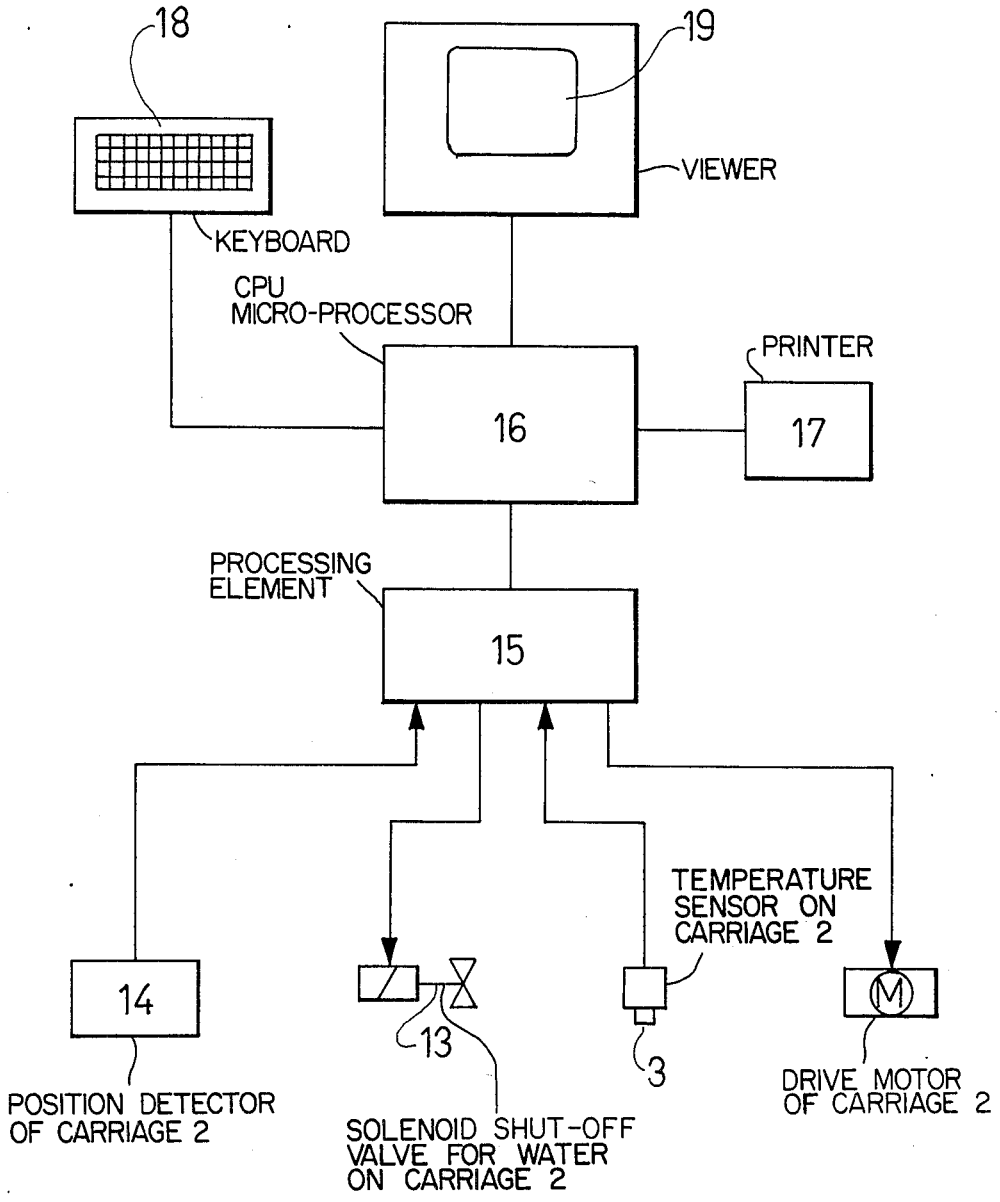
FIG. 5 is a block diagram of the measuring and regulating system.

In the figures, 1 denotes the coke bench, on which the coke 12 is shown as a loose pile of so-prequenched coke from the quenching tower. According to FIG. 1, above the coke bed the carriage 2 runs on rails 8 and 9, which rest on the support 10 and the lower limiting wall 11 of the coke bench 1. This carriage 2 runs back and forth continuously along the entire coke bench via a drive motor M (FIG. 5). At the bottom edge of the chassis of carriage 2, a temperature sensor 3 and a quenching nozzle 4 are arranged side by side at a mount, the mount being applied movably on the carriage through a joint. In FIG. 1, three temperature sensors 3 and three quenching nozzles 4 are arranged which are distributed over the width of the bench. The relatively narrow measuring range of the temperature sensors and also the small range of the quenching nozzles is shown in broken lines in the figure. During movement of the carriage 2, the temperature sensors and quenching nozzles jointly arranged at a mount swing out to the left and right far enough for the entire area of the coke lying on the bench to be covered. Connected with the carriage 2, to the side and at the level of rail 9, are drums 6 and 7, on which are wound both the electric cables (on cable drum 7) and the connecting lines 5 for the quenching water (on drum 6). On the carriage, in the water connecting lines 5 to the individual nozzles, shutoff valves 13 are arranged, which are actuated automatically as a function of the measured temperatures. At a wheel of carriage 2 is arranged furthermore an automatic position detector 14 (FIG. 5) with respective path correction at the bench end-points. By the carriage position detector 14, as shown in FIG. 5 regarding the measuring and regulating system, the respective position of the carriage is conveyed to the processing element 15, and together with the temperature data from the temperature sensor 3 the data are stored in an electronically simulated bench coordinate system and possibly displayed on a viewer 19. At the same time, all important data may be recorded by way of a printer 17. In known manner it is possible to enter or to correct desired values during operation, by way of a keyboard 18 and the central micro-processor or CPU micro-processor 16.

Figure 2:
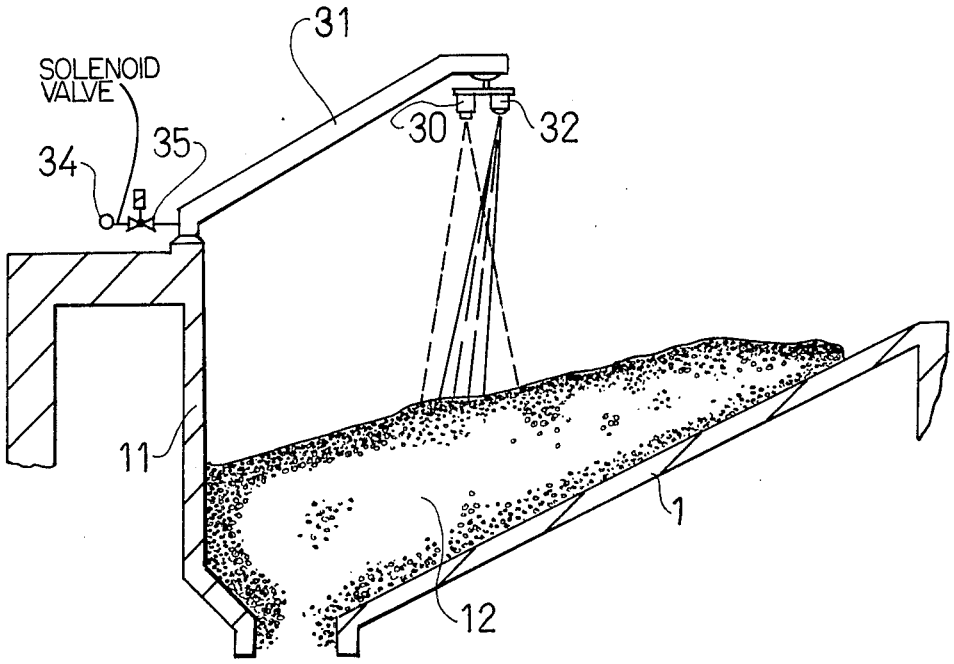
Figure 3:
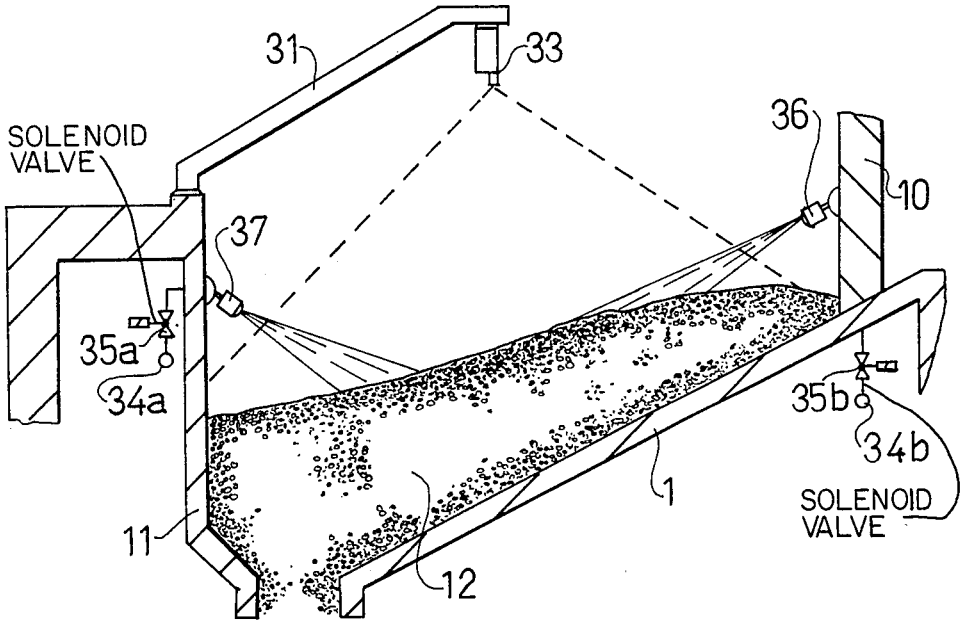
Figure 4:
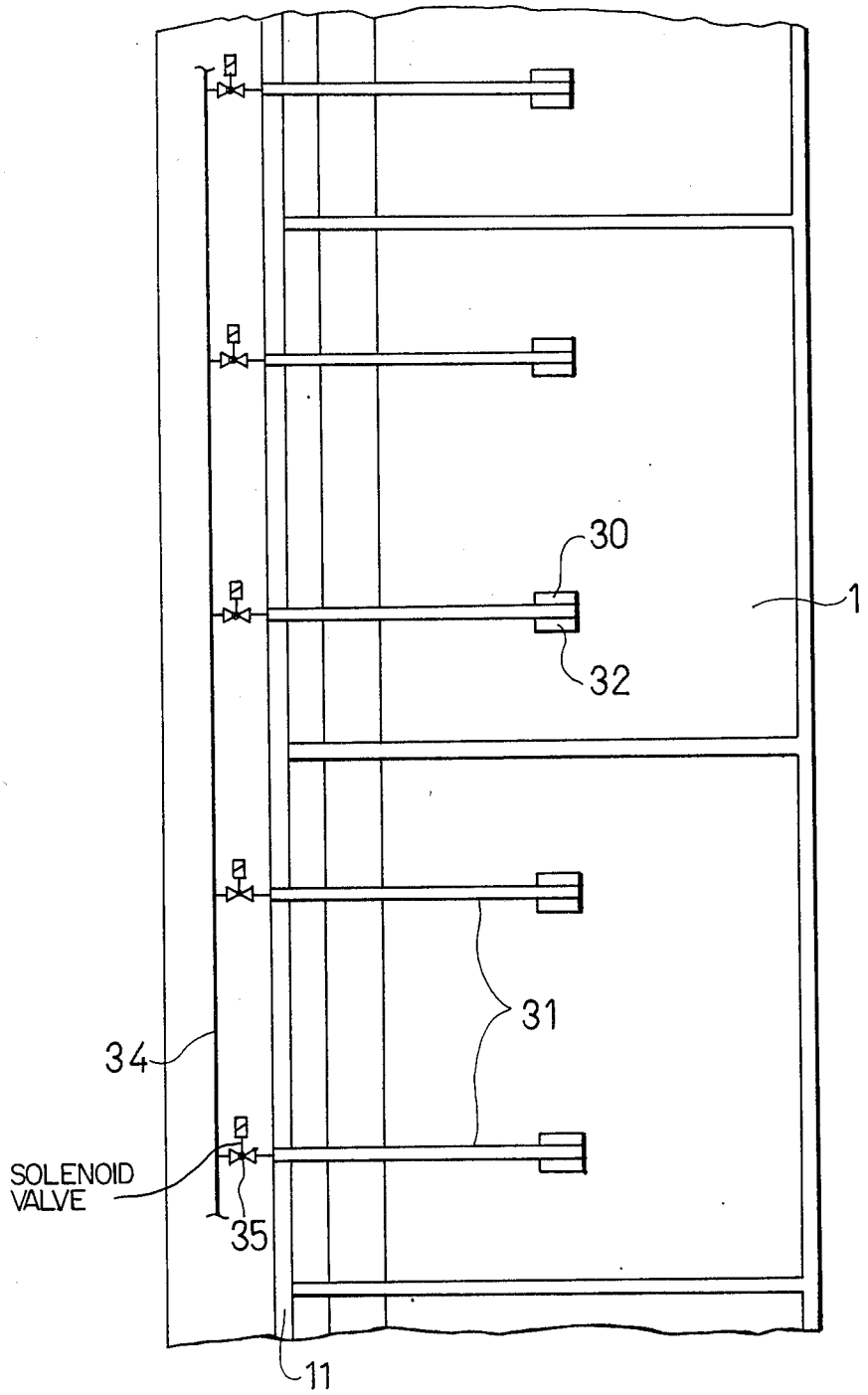
FIG. 4 is a plan view of a part of a quenching bench, from which in principle the position of the supports is evident.

In FIGS. 2 to 4, instead of the movable carriage 2, a number of fixed supports 31 are arranged distributed over the length of the entire coke bench. On these supports 31, according to FIG. 2, the temperature sensors 30 and the respective quenching nozzles 32 are arranged on mounts which in turn are movable. With an appropriate height of the arrangement above the coke surface it is sufficient to use one temperature sensor 30 for scanning the entire width of the coke bench 1. Likewise one quenching nozzle 32 covers both the entire width and a certain longitudinal section of the coke bench. The temperature sensors 30 are connected through permanently installed electrical lines with the central memory and control units, e.g. according to FIG. 5. Furthermore, along the entire coke bench a water line 34 is arranged, from which the individual feed lines to the nozzles 32 branch off. In each of these individual feed lines, automatically controllable shut off valves or water line solenoids or solenoid valves 35 are provided.

In FIG. 3, an infrared camera 33 which covers a relatively large area of the coke bench is installed on the support 31. As an alternative to FIG. 2, in FIG. 3 the quenching nozzles 36 and 37 with the feed lines **34*a*, 34*b*** and the shutoff valves 35*a* and 35*b* are arranged laterally on the supports 10 and, respectively, on the lower limiting wall 11 of the coke bench.

Thus, the method of the invention concerns the selective after-quenching of prequenched hot coke during the time it is lying on a coke bench for final cooling and steaming out prior to being discharged onto a coke bench draw-off belt or the like, and basically involves two steps.

In the first step, e.g. using a temperature sensor and recorder monitoring system, the temperature of the prequenched hot coke lying on the coke bench is sensed and recorded in ongoing or substantially continuous manner with reference to a desired temperature value and over the entire area of the hot coke for detecting locally occurring individual red hot pockets therein having a temperature above such desired value, and in the second step, e.g. using a spray nozzle system, upon each such detection only the detected pocket selectively is automatically after-quenched with a water spray in controlled manner in dependence upon the sensed and recorded temperature and only for the minimum of spraying sufficient for decreasing the temperature of that pocket to below such desired value.

Generally, a distributed array of such sensors in local spaced relation to each other (FIGS. 1–4) is used, which may be moved repeatedly operatively relative to the corresponding local adjacent area portions of the coke bench therebelow for locally monitoring the coke temperature, e.g. by back and forth longitudinal movement of the carriage 2 containing the sensors (FIG. 1) or by articulated movement of the fixed point position sensors via a joint or pivot (FIG. 2), or which may be stationary while having an operative span or range generally coextensive with the bench transverse width (FIG. 3).

A conjoint distributed array of spray nozzles correspondingly locally associated with the sensor array is likewise used (FIGS. 1–4), and which in all cases are moved repeatedly operatively relative to corresponding local adjacent area portions of the coke bench therebelow for locally delivering quenching spray selectively as earlier described (FIGS. 1–3).

For the above purposes, the apparatus includes appropriate sensing means and recording means, including control means, as well as nozzle means associated with the sensing means, such that the control means are arranged for automatically operating selectively the nozzle means, upon each such detection, in controlled manner in dependence upon the sensed and recorded temperature for the stated purposes.

Thus, the recording means may include an associated electronic recorder (FIG. 5) having an electronically simulated coke bench area local coordinate arrangement corresponding to and electronically representing the entire area of the hot coke on the bench for electronically recording the temperature locally sensed by storage as data in the simulated coordinate arrangement and in turn for locally detecting any increase or decrease in temperature of the hot coke relative to the desired value by comparison with the so-stored data. The control means are accordingly operatively connected with the recorder for operating selectively the nozzle means for the stated purposes, e.g. in terms of the processing element and CPU micro-processor which control nozzle spray operation (FIG. 5).

We claim:

1. Method for selective after-quenching of prequenched hot coke during the time it is lying on a coke bench for final cooling prior to being discharged onto a coke bench draw-off belt or the like, and which has been previous produced in a coke oven and thereafter prequenched prior to reaching the coke bench for such final cooling, which comprising the steps of (a) sensing and recording the temperature of such prequenched hot coke lying on the coke bench with reference to a desired temperature value, such that the sensing and recording are substantially continuously carried out over the entire area of the hot coke on the coke bench for detecting locally occurring individual red hot pockets in the hot coke having a temperature above said desired value, (b) upon each such detection automatically after-quenching with a water spray selectively only such detected locally occurring individual red hot pocket in controlled manner in dependence upon the sensed and recorded temperature and only for the minimum time of spraying sufficient for decreasing the temperature of such red hot pocket to below said desired value, wherein the individual red hot pockets of coke are selectively detected and quenched by respective at least one temperature sensor and at least one quench nozzle, both movable over the hot coke.

2. Method of claim 1, wherein upon such detection the step (b) after-quenching is carried out only after a given delay period and only if after such delay period the sensed temperature of the so-detected individual red hot pocket has not meanwhile decreased to below said desired value.

3. Method of claim 1, wherein upon subsequent detection of an increase in the temperature to above said desired value of a previously detected and after-quenched individual red hot pocket, the step (b) after-quenching therof is repeated.

4. Method of claim 1, wherein upon subsequent detection of an increase in the temperature to above said desired value of a previously detected and after-quenched individual red hot pocket, continuous after-quenching is carried out as a safety measure by continuously applying the water spray thereto.

5. Method of claim 1, wherein step (a) is carried out using a temperature sensor and recorder monitoring system in which the sensed temperature is recorded by the recorder, and step (b) is carried out using a water quenching spray nozzle system in dependence upon the sensed and recorded temperature of the monitoring system.

6. Method of claim 5, wherein step (a) is carried out using a distributed array of temperature sensors located above the coke bench and in local spaced relation to each other and moved repeatedly operatively relative to corresponding local adjacent area portions of the coke bench for locally monitoring the temperature of the hot coke, and an associated electronic recorder for electronically recording the temperature locally sensed during such monitoring movement by storage as data in an electronically simulated coke bench area local coordinate arrangement in said recorder corresponding to and electronically representing the entire area of the hot coke on the coke bench, and step (b) is carried out by locally detecting any increase or decrease in temperature of the hot coke on the coke bench relative to said desired value by comparison with the so-stored data.

7. Method of claim 6, wherein the step (b) after-quenching is carried out using a conjoint distributed array of water quenching spray nozzles correspondingly locally associated with the array of temperature sensors and also located above the coke bench and in local spaced relation to each other and correspondingly moved repeatedly operatively relative to such local adjacent area portions of the coke bench synchronously with the movement of the temperature sensors for locally deliverying quenching water spray selectively to a given detected individual red hot pocket for such after-quenching only after a given delay period and only if after such delay period the sensed temperature of the so-detected individual red hot pocket has not meanwhile decreased to below said desired value.

8. Apparatus for carrying out the method of claim 1, for selective after-quenching of prequenched hot coke during the time it is lying on a coke bench for final cooling, which comprises a coke bench adapted for receiving prequenched hot coke which has been previously produced in a coke oven, for final cooling on the coke bench of such prequenched hot coke, and further adapted for discharge of so-finally cooled coke from the coke bench onto a coke bench draw-off belt or the like, sensing means and recording means for correspondingly sensing and recording the temperature of such prequenched hot coke lying on the coke bench with reference to a desired temperature value and arranged for substantially continuously sensing and recording such temperature over the entire area of the hot coke on the coke bench for detecting locally occurring individual red hot pockets in the hot coke having a temperature above said desired value, and water quenching spray nozzle means movably associated with the sensing means over the hot coke bench and arranged for after-quenching with water spray selectively only such detected locally occurring individual red hot pockets, said recording means including control means arranged for automatically operating selectively the nozzle means, upon each such detection, in controlled manner in dependence upon the sensed and recorded temperature of the sensing means and recording means and only for the minimum time of spraying sufficient for decreasing the temperature of such red hot pocket to below said desired value.

9. Apparatus of claim 8, wherein the control means are arranged for operating the nozzle means upon such a detection only after a given delay period and only if after such delay period the sensed temperature of the so-detected individual red hot pocket has not meanwhile decreased to below said desired value.

10. Apparatus of claim 8, wherein the sensing means include a distributed array of temperature sensors located above the coke bench and in local spaced relation to each other and movable repeatedly operatively relative to corresponding local adjacent area portions of the coke bench for locally monitoring the temperature of the hot coke, and the nozzle means include a conjoint distributed array of water quenchiing spray nozzles correspondingly locally associated with the array of temperature sensors and also located above the coke bench and in local spaced relation to each other and correspondingly movable repeatedly operatively relative to such local adjacent area portions of the coke bench synchronously with the movement of the temperature sensors for locally delivering quenching water spray selectively to a given detected individual red hot pocket.

11. Apparatus of claim 8, wherein the recording means includes an associated electronic recorder having an electronically simulated coke bench area local coordinate arrangement corresponding to and electronically representing the entire area of the hot coke on the coke bench for electronically recording the temperatures locally sensed by storage as data in the electronically simulated coke bench area local coordinate arrangement and in turn for locally detecting any increase or decrease in temperature of the hot coke on the coke bench relative to said desired value by comparison with the so-stored data, and the control means are operatively connected with the recorder for operating selectively the nozzle means upon so-detecting an increase in temperature above said desired value of such individual red hot pocket and only for spraying that individual pocket selectively and only until the temperature of that individual pocket decreases to below said desired value.

12. Apparatus of claim 11, wherein the control means are arranged for operating the nozzle means upon such a detection only after a given delay period and only if after such delay period the sensed temperature of the so-detected individual red hot pocket has not meanwhile decreased to below said desired value.

13. Apparatus of claim 8, wherein the coke bench has a longitudinal extent and a corresponding transverse extent, the sensing means and nozzle means are provided on a carriage located above the coke bench and spanning the transverse extent of the coke bench and movable back and forth along the longitudinal extent of the coke bench, the sensing means including a series of transversely spaced apart temperature sensors arranged for locally monitoring corresponding local adjacent area portions of the coke bench during such back and forth movement of the carriage and together covering the range of the entire transverse extent of the coke bench, and the nozzle means include a conjoint series of transversely spaced apart water quenching spray nozzles correspondingly locally associated with the series of temperature sensors and arranged for locally delivering quenching water spray selectively to a given detected individual red hot pocket in the corresponding local adjacent area portions of the coke bench during such back and forth movement of the carriage and together likewise covering the range of the entire transverse extent of the coke bench.

14. Apparatus of claim 13, wherein the temperature sensors and nozzles are movable operatively via a movable mounting relative to the carriage.

15. Apparatus of claim 13, including a water supply source for the nozzles disposed adjacent the coke bench and delivery means for delivering water from the supply source to the nozzles on the movable carriage.

16. Apparatus of claim 15, wherein said delivery means includes a flexible connecting line flow connecting the supply source with the nozzles on the movable carriage.

17. Apparatus of claim 16, wherein the connecting line is arranged on a wind-up drum disposed on the carriage so that the line can be wound on and off of the drum during corresponding movement of the carriage relative to the supply source.

18. Apparatus of claim 15, wherein said delivery means includes a water pump on the carriage.

19. Apparatus of claim 8, wherein the sensing means include a distributed array of temperature sensors located above the coke bed and at fixed points in locally spaced apart relation to each other and movable repeatedly operatively relative to corresponding local adjacent area portions of the coke bench for locally monitoring the temperature of the hot coke, and the nozzle means include a conjoint distributed array of water quenching spray nozzles correspondingly locally associated with the array of temperature sensors and also located above the bed and at fixed points in locally spaced apart relation to each other and correspondingly movable repeatedly operatively relative to such local adjacent area portions of the coke bench for locally delivering quenching water spray selectively to a given detected individual red hot portion.

20. Apparatus of claim 8, wherein the sensing means includes a distributed array of temperature sensors in the form of infrared cameras for plotting thermo patterns of the hot coke on the coke bench and located above the coke bed at fixed points in locally spaced apart relation to each other for covering corresponding local adjacent area portions of the coke bench for locally monitoring the temperature of the hot coke, and the nozzle means include a conjoint distributed array of water quenching spray nozzles correspondingly locally associated with the array of temperature sensor cameras and also located above the bed at fixed points in locally spaced apart relation to each other and movable operatively relative to such local adjacent area portions of the coke bench for locally delivering quenching water spray selectively to a given detected individual red hot portion.

* * * * *